US007464816B2

(12) United States Patent
Klein et al.

(10) Patent No.: US 7,464,816 B2
(45) Date of Patent: Dec. 16, 2008

(54) PRODUCT DISPENSING SYSTEM

(75) Inventors: Ronald T. Klein, Island Lake, IL (US); Barbara T. Skiba, Chicago, IL (US); Charles Rambo, III, Lake in the Hills, IL (US)

(73) Assignee: Sage Products, Inc., Cary, IL (US)

( * ) Notice: Subject to any disclaimer, the term of this patent is extended or adjusted under 35 U.S.C. 154(b) by 129 days.

(21) Appl. No.: 10/979,659

(22) Filed: Oct. 14, 2004

(65) Prior Publication Data

US 2006/0081486 A1 Apr. 20, 2006

(51) Int. Cl.
*B65D 85/62* (2006.01)
*B65D 71/00* (2006.01)
*B65D 73/00* (2006.01)

(52) U.S. Cl. ..... 206/499; 206/461; 206/806

(58) Field of Classification Search ..... 206/499, 206/703–705, 495, 461, 471, 493, 806, 581, 206/362.1, 362.2, 368; 211/59.2, 59.1, 4
See application file for complete search history.

(56) References Cited

U.S. PATENT DOCUMENTS 3,288,280 A * 11/1966 Bostrom ..... 206/461
3,970,194 A * 7/1976 Iten ..... 206/228
4,168,002 A * 9/1979 Crosby ..... 206/459.5
4,474,300 A * 10/1984 Entis ..... 211/57.1
5,855,282 A * 1/1999 Hardy ..... 211/59.1
6,164,617 A * 12/2000 Butterfield et al. ..... 248/690
6,311,845 B1 * 11/2001 Uren et al. ..... 206/774
6,401,304 B1 * 6/2002 Dossett ..... 24/16 PB
6,439,390 B1 * 8/2002 Kumakura et al. ..... 206/705
6,446,819 B1 * 9/2002 Mattesky ..... 211/57.1
6,450,335 B1 9/2002 Yates
6,708,826 B1 3/2004 Ginsberg et al.
7,028,376 B2 * 4/2006 Mattesky ..... 24/16 PB
2003/0136698 A1 * 7/2003 Klatt ..... 206/499

* cited by examiner

*Primary Examiner*—Mickey Yu
*Assistant Examiner*—Steven A. Reynolds
(74) *Attorney, Agent, or Firm*—Barnes & Thornburg LLP

(57) ABSTRACT

A product dispensing system and a method of queuing usage of products. A plurality of layers of products, each having multiple items in separate packages, each layer having a carrier with the separate packages being secured to and extending from the carrier. The layers are assembled in a stacked orientation behind a front layer with layers behind the front layer being at least partially concealed and inaccessible. Products are used one layer at a time, and when the separate packages from the front layer are removed, the packages of the next-succeeding layer are exposed for use.

16 Claims, 1 Drawing Sheet

PRODUCT DISPENSING SYSTEM

BACKGROUND OF THE INVENTION

This invention relates to product dispensing systems and queuing usage of products, and in particular to a system having a plurality of layers of products, with each layer having multiple items in separate packages which can then be dispensed in a layer-by-layer fashion.

Often times products are used in a multiple and repetitious manner. For example, in medical care and with particular reference to mouth care, often a series of mouth care products is used in a repetitious manner, for example in periodic cleaning sessions, where there can be evacuation, brushing of the teeth, and swabbing of the mouth and gums. Different implements are used for each procedure, and with the repetition of each series of procedures at predetermined intervals, such as every few hours, it is advantageous to have all of the necessary implements available to the mouth care professional in an organized and logical manner. This not only facilitates proper care, but also helps avoid missing any critical care steps each time mouth care is undertaken.

SUMMARY OF THE INVENTION

The invention is directed to a product dispensing system comprising a plurality of layers of products, each layer having multiple items in separate packages. A carrier is provided for each layer, the separate packages of each layer being secured to and extending from the carrier for each layer. Means is provided for assembling the layers in a stacked orientation with layers behind a front layer being at least partially concealed and inaccessible.

In accordance with the preferred form of the invention, the assembling means comprises a slot in each carrier and a hang strap threaded through the slots. A bracket is also included for suspending the product dispensing system from the strap. The hang strap is releasably secured to the bracket.

It is preferred there be at least one separator for each layer in order to maintain layer spacing. In the disclosed form of the invention, where products are provided in expanded packaging, the separator for each layer is located on the carrier. The separator preferably comprises a bulge which extends from the carrier.

Typically, the layers are identical. The separate packages are severable from the carrier, and in the preferred form of the invention, the packages are joined to one another at adjoining edges. The packages can be severed from the carrier individually or as a group, exposing the packages of the next-succeeding layer.

In use, the product dispensing system is suspended from the bracket on the hang strap, with the layers oriented one behind the other behind a front layer, thus at least partially concealing subsequent layers and rendering them largely inaccessible. During use or after use of the items in the separate packages of the front layer, the packages are then removed from the front layer by severing them from the carrier, exposing the separate packages of the next-succeeding layer. This process is repeated for each layer until a rear-most layer is reached.

BRIEF DESCRIPTION OF THE DRAWING

The invention is described in greater detail in the following description of examples embodying the best mode of the invention, taken in conjunction with the drawing figures in which.

DESCRIPTION OF EXAMPLES EMBODYING THE BEST MODE OF THE INVENTION

Figure 3:
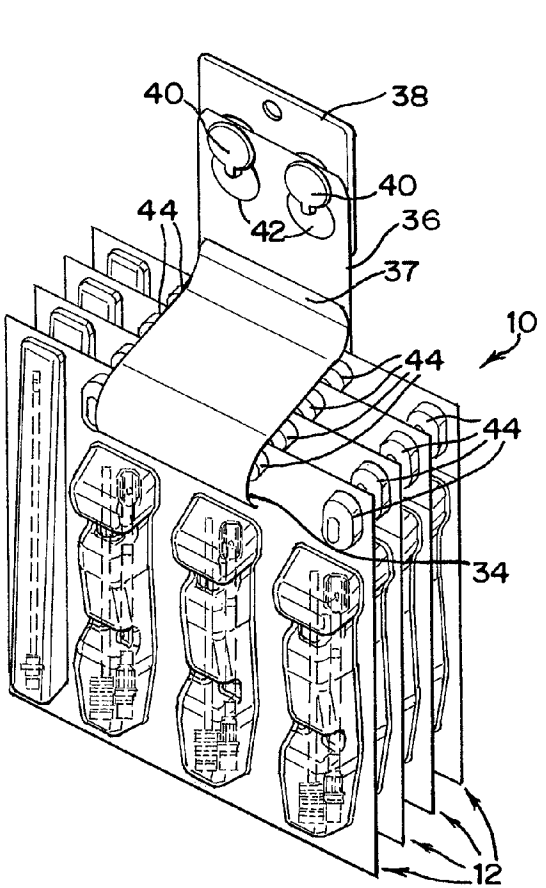
FIG. 3 is a perspective view thereof.

A product dispensing system according to the invention is shown generally at 10 in the drawing figures. The product dispensing system 10 is comprised of a plurality of layers of products 12, each layer having multiple items in separate packages 14, 16, 18 and 20. While four packages are illustrated, any number of packages can compose each of the layers 12. Preferably the layers are identical to one another, although that is not mandatory.

Each of the separate packages 14 through 20 contains whatever item or items are desired, such as, for mouth care, catheters, tooth brushers, oral swabs and cleansing and moisturizing solutions, as needed. What items may be included in each of the separate packages 14 through 20 forms no part of the invention, and what is illustrated in the drawing figures is simply for the purposes of explanation.

Figure 1:
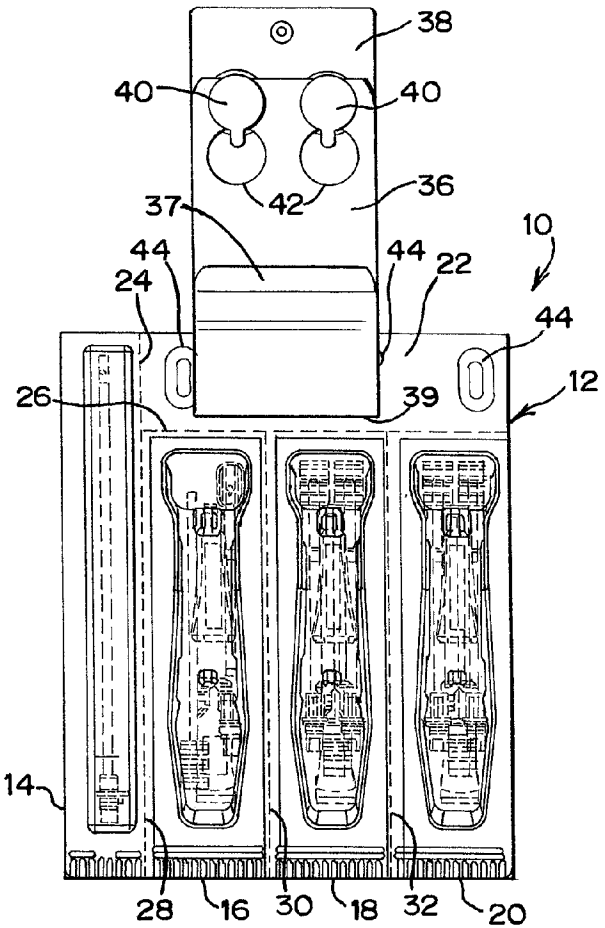
FIG. 1 is a front elevational illustration of a product dispensing system according to the invention, with its hang strap and bracket.

The packages 14 through 20 are secured to and extend from a carrier 22. Some means of promoting severing of the packages 14 through 20 from the carrier 22 is provided, such as perforations 24 and 26, as illustrated in FIG. 1.

The packages 14 through 20 are shown joined to one another, although that is not mandatory. If joined, the packages 14 through 20 join at adjoining edges, and may be severed from one another along perforations 28, 30 and 32.

Figure 2:
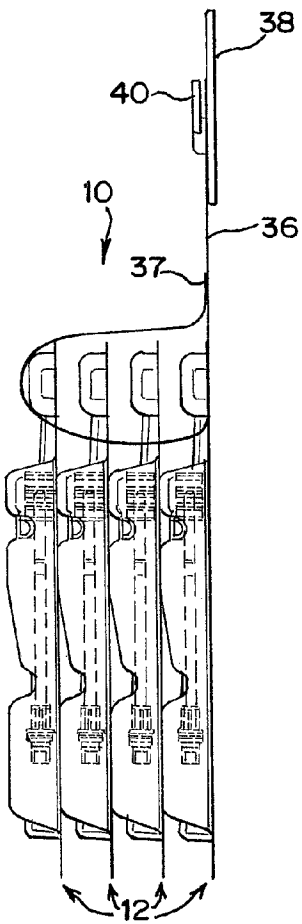
FIG. 2 is a side elevational illustration thereof.

As illustrated, the layers 12 are assembled in a stacked orientation with layers behind a front layer (the left most layer in FIG. 2) being at least partially concealed and therefore inaccessible. For assembling the layers in that orientation and for suspending the product dispensing system 10 for use, each of the carriers 22 includes a slot 34, and a hang strap 36 is threaded through each of the slots 34, the hang strap 36 being looped and joined appropriately to itself at 37, such as by heat sealing, adhesives or any other means of affixing it to form a loop. The loop thus-formed can be as large as desired, and in some instances can be sufficiently large so that one or more additional packages can be slipped into the loop above the plurality of layers of products 12. Thus, when the product dispensing system 10 is used for mouth care, a single irrigating device, which can be used with a catheter found in one of the packages of each of the layers of products 12, can be provided and thus reused as each layer is accessed.

For suspending the product dispensing system for easy accessibility and use, a bracket 38 (connector) may be included which can be appropriately affixed to a wall or any other vertical surface. The bracket 38 (connector) includes a pair of hooks 40 and the hang strap 36 includes a corresponding pair of apertures 42 in registration with the hooks 40.

Each of the separate packages 14 through 20 has a particular depth, which promotes separation of the layers 12 when assembled as shown in the drawings. However, the carriers 22 typically are generally flat, and have very little depth. Therefore, a series of separators 44 is provided on each of the carriers 22 to help maintain spacing of the layers of products 12. The separators 44 comprise bulges which extend from the carriers 22, thus adding depth to the carriers 22 and promoting proper spacing as shown in the drawing figures.

The system 10 according to the invention provides a method of queuing the usage of products. The layers of products 12 are provided, each with its separate packages 14 through 20, each of the packages being individually accessible and severable from the carrier 22. With the layers in a stacked orientation, the layers of products 12 behind the front layer (the left-most layer in FIG. 2) are at least partially concealed and inaccessible. Once the items in the separate packages 12 through 14 have been appropriately used, the packages can be severed from one another along the perforations 28 through 32, and the packages can also be removed from the carrier 22 along the perforations 24 and 26, thus exposing the next-succeeding layer of products 12. The items in the separate packages of that layer can then be accessed and used, and the process repeated for each of the layers of products 12.

While four separate packages 14 through 20 are illustrated, with the package 14 being shown as longer than the other packages, it will be apparent that any number of packages can be utilized, extending from an appropriately sized carrier 22. Also, while the packages 14 through 20 are preferably formed in a "card" or layer as illustrated with perforations 28 through 32 for severing purposes, the separate packages 14 through 20 can also be spaced from one another rather than contiguous.

The layers of products 12 are shown generally one behind the other in the drawing figures, suspended from a flexible hang strap 36, such as a plastic strip. The layers of products 12 need not be fully aligned one behind the other, but can be somewhat staggered, if desired. Also, rather than a hang strap 36, a rigid wall bracket, extending through the slots 34, can be used for assembling the layers in their stacked orientation.

Various changes can be made to the invention without departing from the spirit thereof or scope of the following claims.

What is claimed is:

1. A method of queuing usage of products, comprising a. providing a plurality of layers of products, with each layer having multiple items in first and second separate packages, which are individually accessible and with the first and second separate packages of each layer being secured to and extending from a carrier, and at least some of each of said first and second separate packages of each layer further being individually severable from said carrier, b. permanently arranging the layers and carriers in a stacked and sequenced orientation in a set fashion that cannot be rearranged with layers behind a front layer being at least partially concealed and inaccessible, c. displaying the permanently arranged layers, d. removing any one of the first and second separate packages from the front layer without removing a second one of the first and second separate packages from the front layer, exposing a corresponding one of the first and second separate packages of a next-succeeding layer, and e. repeating method step d for each layer until a rear layer is exposed.

2. The method according to claim 1, in which method steps b and d are performed at predetermined intervals.

3. A product dispensing system comprising a. a plurality of layers of products, each layer having multiple items in first and second separate packages, b. a carrier for each layer, said first and second separate packages of each layer being secured to and extending from the carrier for each layer, and at least some of said first and second separate packages of each layer further being individually severable from said carrier without removing another of the separate packages, c. a slot in each carrier, d. a connector adapted for retaining said carriers in a stacked and sequenced orientation, said connector comprising a hang strap threaded through said slots, the strap having two apertures for suspending the product, and e. a display with the connector permanently arranging the carriers in a stacked orientation while individual products are displayed and removed from the display.

4. The product dispensing system according to claim 3, including a bracket for suspending the product dispensing system.

5. The product dispensing system according to claim 4, in which said hang strap is releasably secured to said bracket.

6. The product dispensing system according to claim 3, including at least one separator for each layer to maintain layer spacing.

7. The product dispensing system according to claim 6, in which said separator for each layer is located on said carrier.

8. The product dispensing system according to claim 7, in which each separator comprises a bulge extending from said carrier.

9. The product dispensing system according to claim 3, in which said layers are identical.

10. The product dispensing system according to claim 3, in which said packages are joined to one another at adjoining edges.

11. A product dispensing system comprising a. a plurality of layers of products, each layer having multiple items in first and second separate packages, b. a carrier for each layer, said first and second separate packages of each layer being secured to and extending from the carrier for each layer, and at least some of said first and second separate packages of each layer further being individually severable from said carrier without removing another of the separate packages, c. a slot in each carrier, d. a connector adapted for retaining said carriers in a stacked and sequenced orientation, said connector comprising a hang strap threaded through said slots, e. a display with the connector permanently arranging the carriers in a stacked orientation while individual products are displayed and removed from the display, and f. a bracket for suspending the product dispensing system, wherein the strap is releasably secured to the bracket for suspending the product from the dispensing system by at least one hook and at least one aperture when the hook is in registration with the aperture.

12. The product dispensing system according to claim 11, including at least one separator for each layer to maintain layer spacing.

13. The product dispensing system according to claim 12, in which said separator for each layer is located on said carrier.

14. The product dispensing system according to claim 13, in which each separator comprises a bulge extending from said carrier.

15. The product dispensing system according to claim 11, in which said layers are identical.

16. The product dispensing system according to claim 11, in which said packages are joined to one another at adjoining edges.

* * * * *